United States Patent [19]

Jackson

[11] 4,280,436

[45] Jul. 28, 1981

[54] BOAT HULL ANTI-FOULING SHROUD

[76] Inventor: Robert Jackson, 89 Woodward Island, Clearwater, Fla. 33515

[21] Appl. No.: 157,229

[22] Filed: Jun. 6, 1980

Related U.S. Application Data

[62] Division of Ser. No. 883,414, Mar. 6, 1978, Pat. No. 4,215,644.

[51] Int. Cl.[3] ..... B63B 59/00

[52] U.S. Cl. ..... 114/222; 114/230; 405/64; 405/66; 405/68

[58] Field of Search ..... 114/44, 45, 54, 222, 114/230; 405/63, 64, 65, 66, 68

[56] References Cited

U.S. PATENT DOCUMENTS

| | | | |
|---|---|---|---|
| 2,478,217 | 8/1949 | Walters et al. | 114/230 |
| 3,142,283 | 7/1964 | Fisher | 114/45 X |
| 3,205,851 | 9/1965 | Wiswell, Jr. | 114/222 |
| 3,570,256 | 3/1971 | Thompson | 114/222 X |
| 3,599,434 | 8/1971 | Missud | 405/68 X |
| 3,839,870 | 10/1974 | Ryan | 405/64 |

FOREIGN PATENT DOCUMENTS

| | | | |
|---|---|---|---|
| 1094883 | 12/1967 | United Kingdom | 114/222 |

*Primary Examiner*—Sherman D. Basinger
*Attorney, Agent, or Firm*—Stanley M. Miller

[57] ABSTRACT

A selectively floatable protective shroud is disclosed for protecting a boat hull from fouling by marine organisms. The assembly consists of an inflatable, elongated toroidal bladder with an inner opening larger than the circumference of the hull of the boat at its water line. The bladder has an inflation nozzle which is connected to a gas pump, for controllably inflating the bladder. A continuous, flexible, water impervious shroud has a circumferential edge mounted about the circumference of the toroidal bladder for protecting the boat hull, when deployed about the boat. By controllably inflating the bladder, the shroud is selectively brought from a submerged position beneath the boat to a deployed position enveloping the hull of the boat so as to protect the hull from fouling by marine organisms. A water pump is disclosed being connected to a water drain nozzle mounted on the flexible shroud, for controllably pumping out sea water from the region between the flexible shroud and the boat hull. Various embodiments for guide members are disclosed which are mounted to the sea bed floor and are connected to the bladder for guiding the shroud from the submerged position to the deployed position enveloping the hull of the boat. Various control and interlock mechanisms are disclosed for conveniently operating the system from onboard the boat.

1 Claim, 17 Drawing Figures

SEC. A - A'

SEC. B - B'

BOAT HULL ANTI-FOULING SHROUD

This is a division of application Ser. No. 883,414 filed Mar. 6, 1978, now U.S. Pat. No. 4,215,644.

FIELD OF THE INVENTION

The invention disclosed broadly relates to boating accessories and more particularly relates to anti-fouling devices for boat hulls.

BACKGROUND OF THE INVENTION

Marine organisms such as algae, barnacles and teredos or shipworms, do extensive damage to the hulls of boats. The organisms are world wide in distribution and generally live in marine or brackish water although a few species are found in fresh water. They can be extremely destructive to wooden vessels and have been of great concern to maritime people since the earliest times. The ships of Archimedes of Syracuse were protected by a sheathing of lead against the depredations of marine organisms. Copper sheathing was first used by the British in 1758. Although these techniques provided protection to wooden hulls from the toredos, the accumulation of barnacles and algae was not prevented and the sheathing of a boat with such heavy material substantially reduces its mobility. Other techniques to reduce the damage produced by marine organisms has included the use of specialized paints containing a coal-tar creosote solution or paints having a copper base. Fiberglass coatings have also been used to some extent on small boats and a glue used in making marine plywood has been developed which deters marine borers. However, these techniques still do not protect against the accumulation of barnacles and algae.

OBJECTS OF THE INVENTION

It is therefore an object of the invention to provide an improved form of protection for a boat hull against the damage produced by marine organisms.

It is still another object of the invention to provide a mechanism for protecting a boat hull from marine organisms which may be conveniently deployed from onboard the boat.

SUMMARY OF THE INVENTION

These and other objects, features and advantages of the invention are accomplished by the boat hull anti-fouling shroud disclosed herein.

A selectively floatable protective shroud is disclosed for protecting a boat hull from fouling by marine organisms. The assembly consists of an inflatable, elongated toroidal bladder with an inner opening larger than the circumference of the hull of the boat at its water line. The bladder has an inflation nozzle which is connected to a gas pump, for controllably inflating the bladder. A continuous, flexible, water impervious shroud has a circumferential edge mounted about the circumference of the toroidal bladder for protecting the boat hull, when deployed about the boat. By controllably inflating the bladder, the shroud is selectively brought from a submerged position beneath the boat to a deployed position enveloping the hull of the boat so as to protect the hull from fouling by marine organisms. A water pump is disclosed being connected to a water drain nozzle mounted on the flexible shroud, for controllably pumping out sea water from the region between the flexible shroud and the boat hull. Various embodiments for guide members are disclosed which are mounted to the sea bed floor and are connected to the bladder for guiding the shroud from the submerged position to the deployed position enveloping the hull of the boat. Various control and interlock mechanisms are disclosed for conveniently operating the system from onboard the boat.

DESCRIPTION OF THE FIGURES

These and other objects, features and advantages of the invention can be more fully appreciated with reference to the accompanying figures.

DISCUSSION OF THE PREFERRED EMBODIMENT

Figure 1:
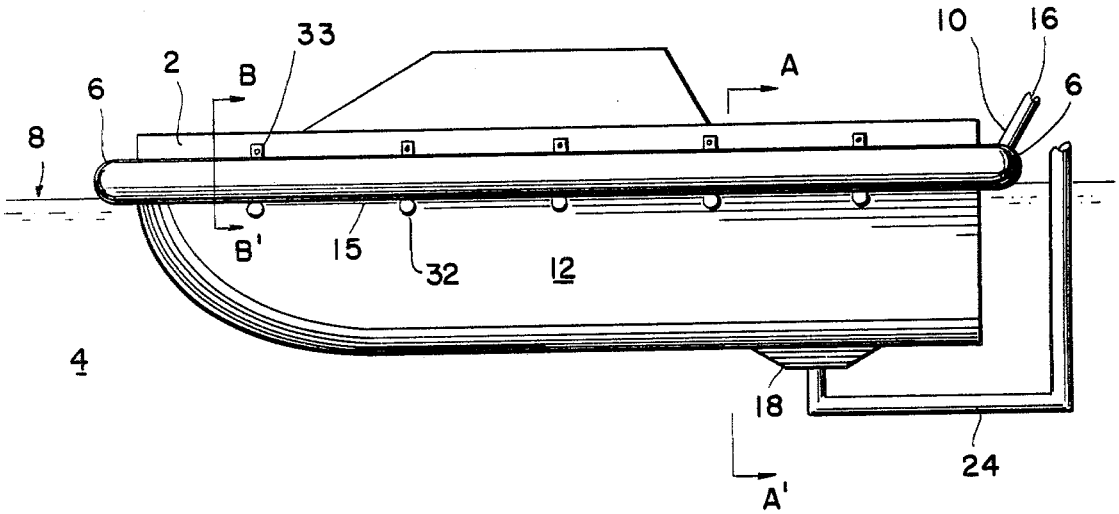
FIG. 1 is a side view of the boat hull anti-fouling shroud.
Figure 2:
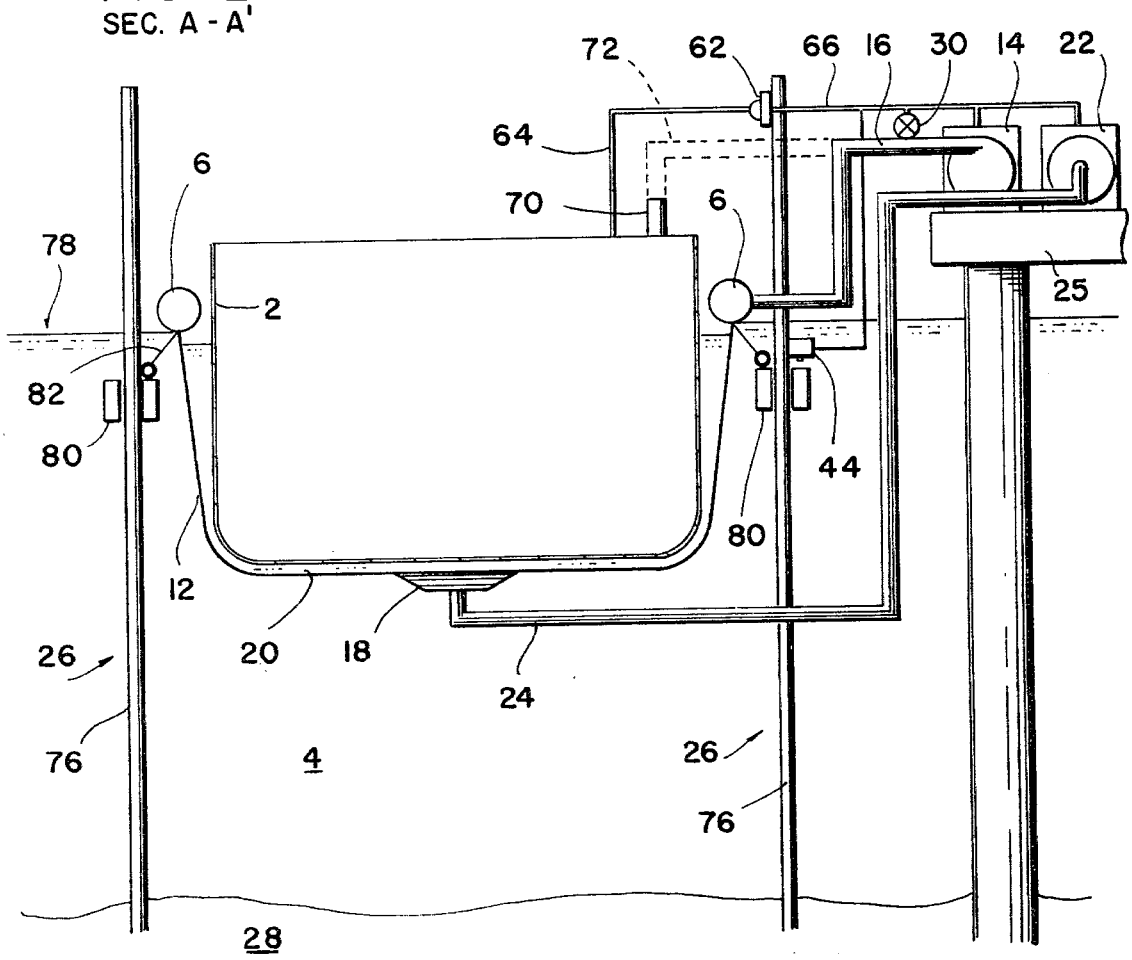
FIG. 2 is a cross sectional view along the section lines A—A' of the invention shown in FIG. 1, and further including guide members 26 and hydraulic and pneumatic pumping systems.
Figure 3:
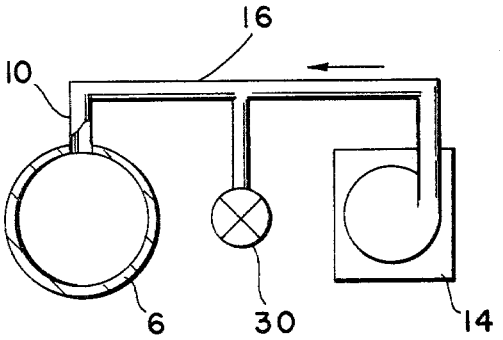
FIG. 3 is a schematic diagram of the pneumatic circuit for the invention.

The selectively floatable protective shroud for the boat hull is shown in FIGS. 1 and 2. The assembly includes an inflatable, elongated toroidal bladder 6 having an inner opening larger than the circumference of the boat hull 2 at the water line 8 of the body of water 4. The bladder 6 includes an inflation nozzle 10. A continuous, flexible, water impervious shroud 12 has its circumferential edge 15 mounted about the circumference of the toroidal bladder 6. The shroud 12 protects the hull 2 when deployed about the boat as is shown in FIGS. 1 and 2. A gas pump 14 is connected by means of the hose 16 to the inflation nozzle 10 of the bladder 6. The gas pump controllably inflates the bladder 6 to selectively float the shroud 12 from a submerged position beneath the boat to a deployed position enveloping the hull 2 of the boat. In this manner, the boat hull 2 is selectively protected from exposure to marine organisms in the body of water 4. FIG. 3 shows a schematic diagram of the pneumatic circuit connecting the air pump 14 to the bladder 6, for selectively inflating the bladder 6.

Figure 4:
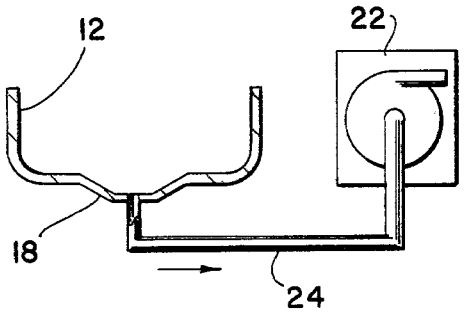
FIG. 4 is a schematic view of the hydraulic circuit for the invention.

The apparatus further includes a water drain nozzle 18 mounted on the bottom of the flexible shroud 12 for evacuating sea water from the region 20 between the flexible shroud 12 and boat hull 2. A water pump 22 connected by means of the hose 24 to the water nozzle 18, controllably pumps out the sea water from the region 20. A schematic diagram of the hydraulic system for pumping the water with the pump 22 is shown in FIG. 4.

The apparatus further includes a guide member 26 which is anchored to the sea bed floor 28 and connected to the bladder 6, for guiding the shroud 12 from the submerged position beneath the boat into the deployed position enveloping the hull 2 of the boat.

As is shown in FIG. 3, the apparatus further includes a gas purge valve 30 connected to the bladder 6, for purging the gas inflating the bladder 6 so as to move the shroud from the deployed floating position to the submerged position. In this manner, the shroud 12 can be moved out of the way of the boat when it is desired to move the boat away from the docking area occupied by the shroud.

FIG. 1 shows the further provision of ballast weights 32 mounted to the bladder 6 to facilitate submerging the shroud 12 when the gas purge valve 30 is opened, collapsing the bladder 6.

Figure 5:
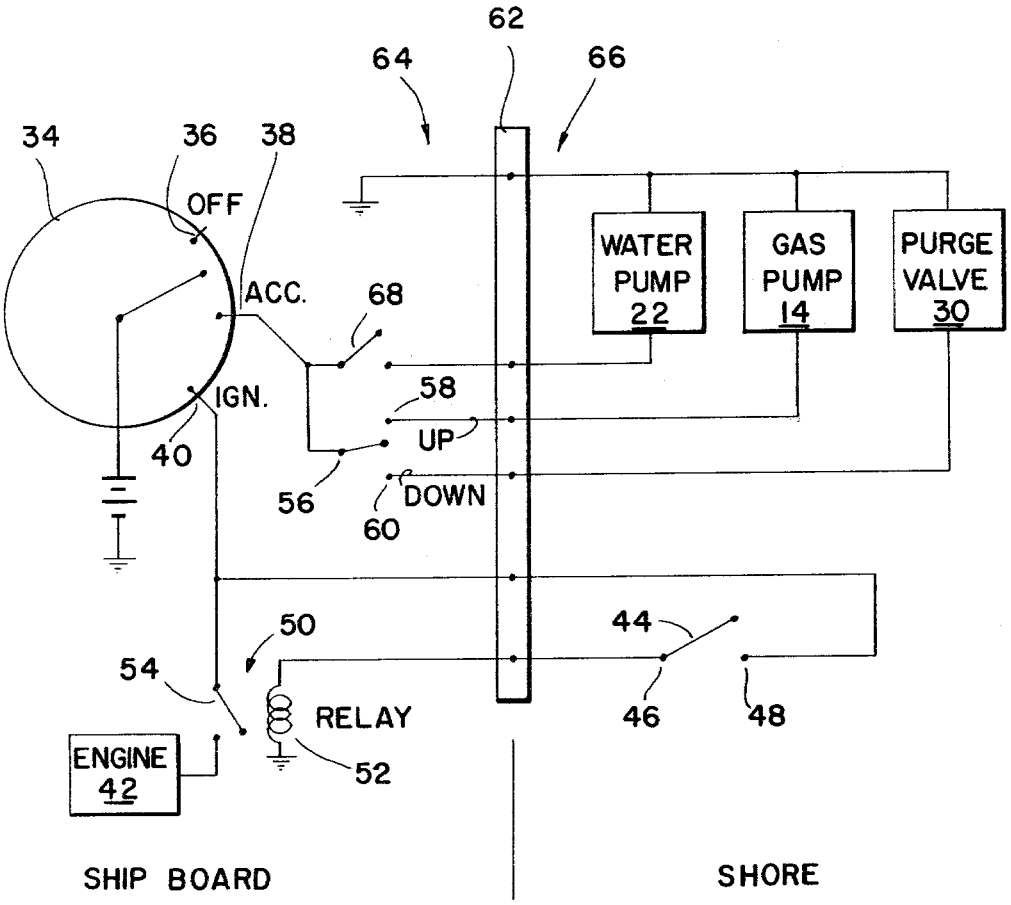
FIG. 5 is a schematic view of the electric circuit for the invention, showing shipboard and shore portions connected through connector 62.

FIG. 5 shows an electrical circuit schematic diagram of the invention. Included in the circuit shown in FIG. 5 is a main electrical switch 34 which is mounted on the boat, for selectively connecting a battery to an off position 36, an accessory power position 38 or an engine ignition position 40. The boat may be motively powered by an internal combustion engine 42 which is electrically connected to the main electrical switch 34 at the ignition position 40, for starting internal combustion when the main switch 34 is placed in the engine ignition position 40. An electrical limit switch 44 is mounted on the guide member 26 and has a normally open circuit between the two contact electrodes 46 and 48. The limit switch 44 is mechanically actuated by motion of the bladder 6 as its floats into its deployed position, closing the circuit between the two electrodes 46 and 48. A normally closed electrical relay switch 50 mounted onboard the boat, has control electrodes 52 connected to contact electrode 46 of the limit switch 44 and has a switching portion 54 which is normally closed when the control electrodes 52 are not energized. The switching portion 54 of the relay 50 is connected in series between the engine ignition portion 40 of the main switch 34 and the engine 42.

The electrical system operates as follows. The limit switch 44 is mechanically actuated by the upward motion of the bladder 6 into its floating, deployed position so as to close the circuit between the contact electrodes 46 and 48. This energizes the control electrodes 52 of the relay 50 whose switching portion 54 is thereby open circuited, interrupting the electrical connection between the main switch 34 and the engine 42. The result is an interlocking function preventing the starting of the internal combustion engine 42 when the shroud 12 is deployed about the boat hull 2 so as to protect the shroud from damage by the engine's propeller.

FIG. 5 shows additional circuitry for use when the gas pump 14 is electrically actuated and the gas purge valve 30 is electrically actuated. An electrical pumping switch 56 mounted on the boat has a first terminal 58 electrically connected to the gas pump 14 and a second terminal 60 electrically connected to the gas purge valve 30, for selectively inflating or purging gas, respectively, in the bladder 6. In this manner, the selective flotation of the shroud 12 is controlled from onboard the boat.

FIG. 5 further shows an electrical plug connector 62 for connecting the electrical cable 64 onboard the boat to the electrical cable 66 leading away from the boat, as is shown in FIG. 2, to connect the main switch 34 to the limit switch 44 and to connect the electrical pumping switch 56 to the gas pump 14 and gas purge valve 30. A water pump electrical switch 68 is mounted onboard the boat and is electrically connected to the water pump 22 for controlling the pumping of sea water from the region 20 from onboard the boat. The electrical plug connector 62 electrically connects the water pump electrical switch 68 to the water pump 22.

An alternate embodiment of the system is shown in FIG. 2 where the gas pump may be the exhaust system 70 of the internal combustion engine 42 powering the boat, which is connected by means of a gas hose 72 to the inflation nozzle 10 of the bladder 6.

Figure 6:
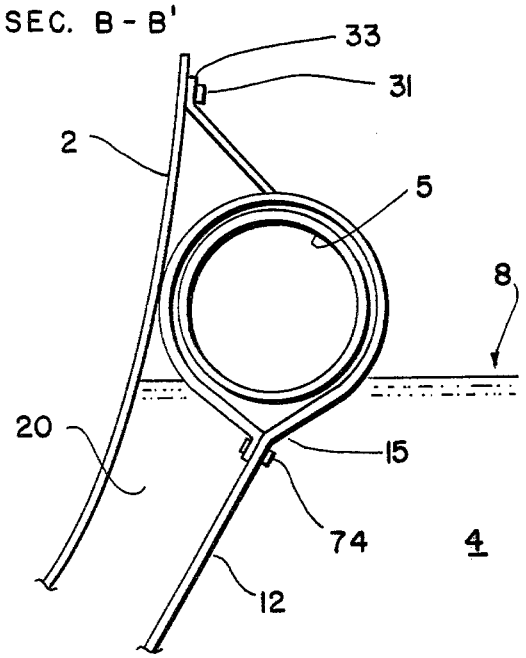
FIG. 6 is a cross sectional view along the section B—B' of the bladder shown in FIG. 1.

The flexible shroud 12 may include a plurality of fasteners 74, as is shown in FIG. 6, mounted about the circumference of the shroud 12, for releasably mounting the shroud 12 to the bladder 6. In this manner, the flexible shroud 12 may be easily disposed of when fouled or damaged and replaced by a new disposable flexible shroud 12. The shroud 12 may be fastened to the boat hull 2 by means of the straps 33 which may be buttoned to the hull 2 with the buttons 31.

The flexible shroud 12 may be composed of materials which are thin, impervious to water, and flexible. Among the materials which may be used are a polyolefin film, a polystyrene film, a polyvinyl chloride film and a polyester film. More particularly, the materials which may be employed include polyethylene, polypropylene, polyvinyl chloride and polyethylene terephthalate.

Plasticized polyvinyl chloride film employs a primary plasticizer such as a phthalate. Sheets of such plasticized polyvinyl chloride having a wall thickness of approximately 0.020 inches will withstand a range of water pressures of from 0–10 or more pounds per square inch without exceeding the elastic limit of the material. Another preferred material is the polyester polyethylene terephthalate, better known by its trade name of Mylar. Polyethylene terephthalate films are relatively unaffected by hydrocarbons and most common organic liquids, including esters and dry cleaning solvents and by formic, acedic, phosphoric and hydrofloric acids. Its films are flexible to minus 70° C. and are serviceable up to 150° C. Its wet strength is substantially the same as is its dry air strength and will withstand exterior weathering quite well and is unaffected by bacteria, fungi or insects.

In the use of the boat hull anti-fouling shroud invention, the sea water may be pumped out of the region 20 and no fluid replaced therein, so that the shroud serves as a dry dock for the boat hull 2. Alternately, the region 20 may be refilled with fresh water so that the hull does not dry out and yet is isolated from the harmful effects of marine organisms. Chemicals such as copper sulfate may be added to the fresh water introduced into the region 20 to kill any micro-organisms such as toredos, which may have come into contact with the surface of the hull 2 during the period when the boat was at sea.

FIG. 2 shows the preferred embodiment for the guide member 26. The guide member 26 is a pair of poles 76 anchored to the sea bed floor 28 and extending vertically toward the surface 78 of the water 4 on opposite sides of the boat 2. The pair of poles 76 may be positioned at midship or alternately two pairs of poles 76 may be employed, a first pair positioned at the bow and a second pair positioned at the stern of the boat. A pair of ring members 80 are respectively mounted in sliding engagement with each of the poles 76 and connected by means of the ropes 82 to the bladder 6. The bladder 6 has its motion constrained by the poles 76 and ring members 80 to remain in substantially the vertical direction in transferring the shroud 12 between the floating and submerged positions. The ring members 80 may include a ballast weight to assist in submerging the shroud when the bladder is deflated.

Figure 7A:
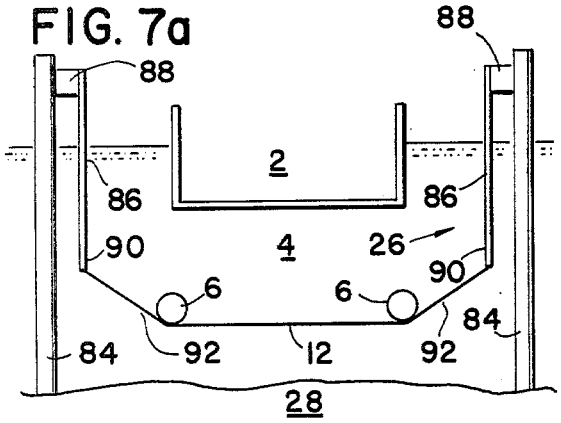
FIG. 7*a* is a cross sectional view of a first alternate embodiment of the invention with the shroud submerged.
Figure 7B:
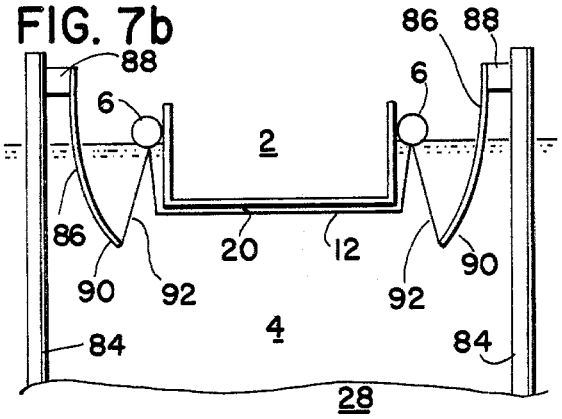
FIG. 7*b* is a cross sectional view of the invention of FIG. 7*a* with the shroud floating.

The first alternate embodiment of the guide members 26 is shown in FIGS. 7*a* and 7*b*. A pair of pilings 84 are mounted to the sea bed floor 28 on opposite sides of the boat 2. A pair of flexible rods 86 are each respectively vertically mounted at mounting points 88 at the upper ends of the rods to one of pilings 84, with its respective lower end 90 connected by means of the rope 92 to the bladder 6. The bladder exerts a buoyant force on the lower end 90 of each of the rods 86 when undergoing inflation. This buoyant force bends the rods 86 towards each other and upwardly toward the surface 78 of the water 4. The bending motion of the rods 86 guides the shroud 12 into juxtaposition with the boat 2 floating between the pilings 84. The flexible rods 86 may be constructed of a fiberglass composite.

Figure 8A:
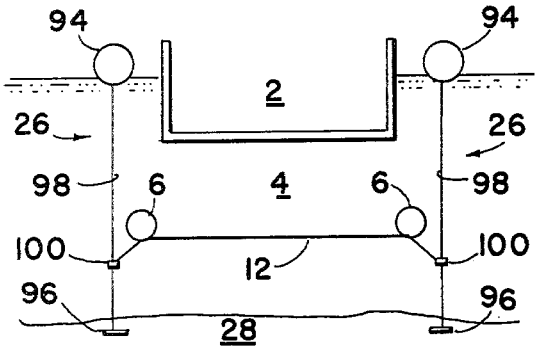
FIG. 8*a* is a cross sectional view of a second alternate embodiment of the invention with the shroud submerged.
Figure 8B:
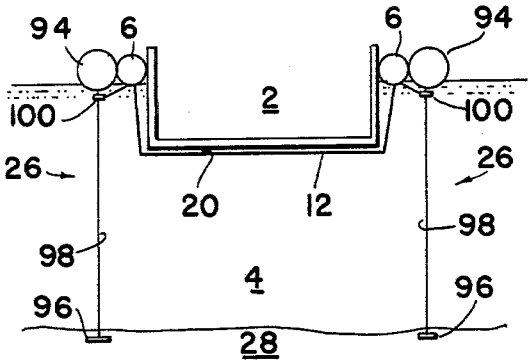
FIG. 8*b* is a cross sectional view of the invention of FIG. 8*a* with the shroud floating.

A second alternate embodiment of the guide members 26 is shown in FIGS. 8*a* and 8*b*. A pair of buoys 94 are anchored by anchors 96 to the sea bed floor 28 by guy wires 98 on opposite sides of the boat 2. A pair of ring members 100 are respectively mounted in sliding engagement with each of the guy wires 98 and are connected to the bladder 6. The bladder 6 has its motion constrained by the guy wires 98 and ring members 100 to remain in substantially the vertical direction in transferring the shroud 12 between the floating and submerged positions.

Figure 9A:
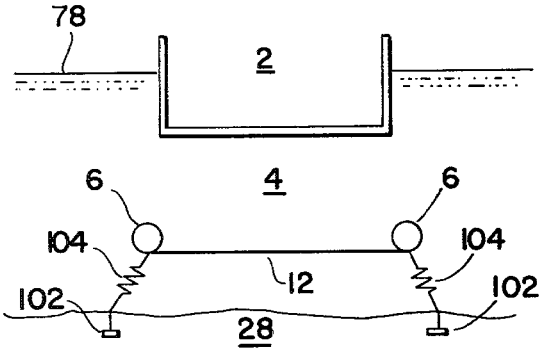
FIG. 9*a* is a third alternate embodiment of the invention with the shroud submerged.
Figure 9B:
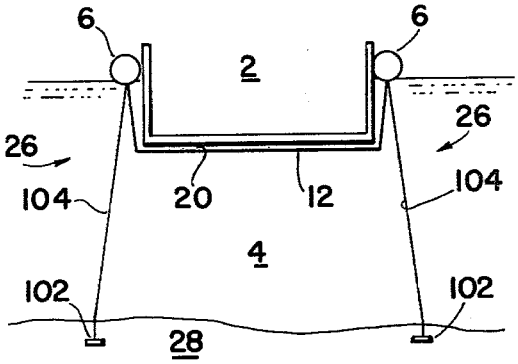
FIG. 9*b* is a view of the invention of FIG. 9*a* with the shroud floating.

A third alternate embodiment of the invention is shown in FIGS. 9*a* and 9*b* for the guide members 26. A pair of anchors 102 are mounted to the sea bed floor 28 on the opposite sides of the boat 2. A pair of elastic members 104, which may be composed of synthetic rubber, are respectively mounted to each of the anchors 102 and are connected to the bladder 6. The bladder 6 has its motion constrained by the anchors 102 and elastic members 104 to remain in substantially the vertical direction in transferring the shroud 12 between the floating and submerged position.

Figure 10A:
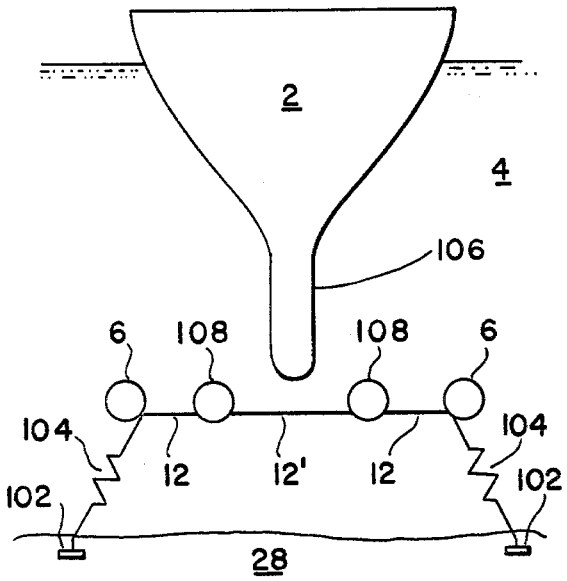
FIG. 10*a* is a view of a fourth alternate embodiment of the invention employing two air bladders to conform to the shape of a boat with a keel, showing the shroud fully submerged.
Figure 10B:
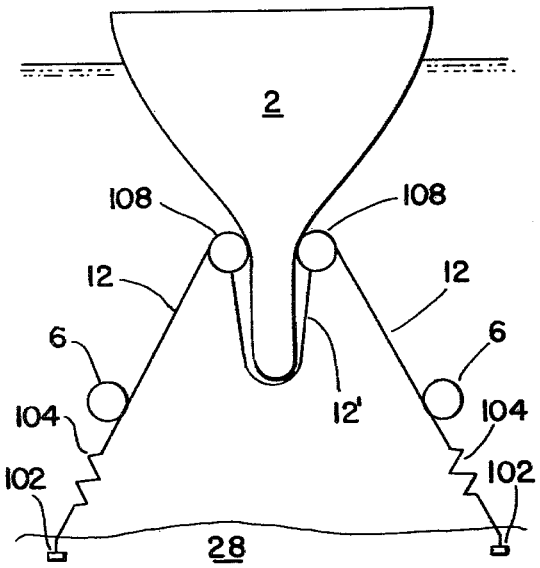
FIG. 10*b* is a view of the invention of FIG. 10*a* with the middle portion of the shroud enveloping the keel of the boat.
Figure 10C:
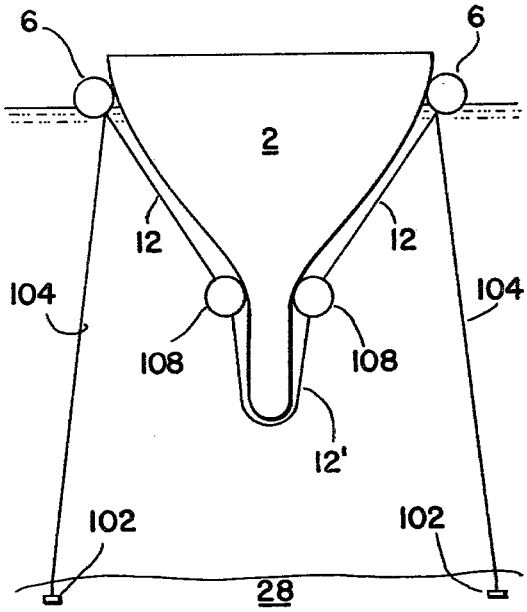
FIG. 10*c* is a view of the invention of FIG. 10*a* with the shroud fully floating.

A fourth alternate embodiment of the invention is shown in FIGS. 10*a* to 10*c*. The boat 2 is shown having a keel portion 106 extending beneath the hull 2. A second inflatable, elongated toroidal bladder 108 having an inner opening larger than the horizontal cross section of the keel portion 106 of the boat 2, has an outer size smaller than the circumference of the hull 2 of the boat at the water line 8. The second inflatable, elongated toroidal bladder is mounted in a central portion 12' of the flexible shroud 12, within the confines of the bladder 6. The second bladder 108 is inflated to envelope the keel 106 of the boat 2 prior to the inflation of the bladder 6, which positions the central portion of the shroud 12' around the keel prior to the positioning of the outer portion of the shroud 12 around the hull 2 of the boat. In this manner, less water is entrained between the shroud assembly and the boat.

Figure 11A:
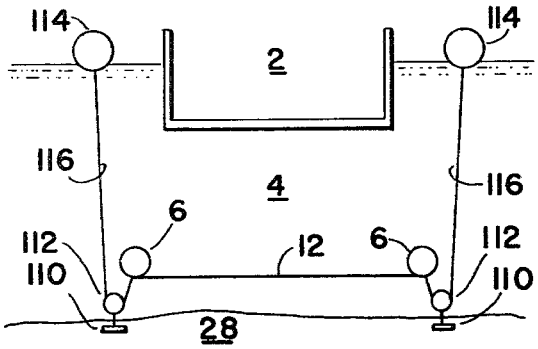
FIG. 11*a* is a view of a fifth alternate embodiment of the invention with the shroud submerged.
Figure 11B:
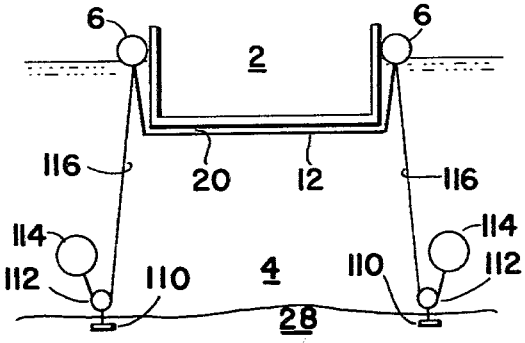
FIG. 11*b* shows the invention of FIG. 11*a* with the shroud floating.

FIGS. 11*a* and 11*b* show a fifth alternate embodiment of the guide members 26 A pair of anchors 110 are mounted to the sea bed floor 28 on opposite sides of the boat 2. A pair of pulleys 112 are respectively mounted to each of the anchors 110. A pair of buoys 114 are respectively connected to one of a pair of guy wires 116 which each pass through a respective one of said pair of pulleys 112. Each guy wire 116 is connected at opposite ends to the bladder 6. The bladder 6 has its motion constrained by the guy wires 116, the pulleys 112, the anchors 110, and the buoys 114 to remain in substantially the vertical direction in transferring the shroud 12 between the floating and the submerged positions.

An alternate embodiment of the invention may provide a protective wire mesh mounted on the flexible shroud 12 in juxtaposition with a rudder or other protrusion which extends downwardly from the hull 2 of the boat. The protective wire mesh protects the shroud 12 from damage by the rudder.

Thus it is seen that the boat hull anti-fouling shroud assembly provides an improved means for reducing the incidence of damage from marine microorganisms on the hull of the boat. The shroud assembly is conveniently deployed around the boat hull by means of control mechanisms which are operated from onboard the craft.

Although specific embodiments of the invention have been disclosed herein, it will be understood by those skilled in the art that various changes can be made in the selection of materials, construction and shape of the elements of the invention, without departing from the spirit and the scope of the invention.

I claim:

1. A selectively floatable protective shroud for a boat hull floating in a body of water, comprising:

an inflatable, elongated toroidal bladder with an inner opening larger than the circumference of the hull of said boat at its waterline, having an inflation nozzle, located in said body of water;

a continuous, flexible, water impervious shroud having a circumferential edge mounted about the circumference of said torodial bladder, for protecting said hull when deployed about said boat;

a gas pump connected to said inflation nozzle of said bladder, for controllably inflating said bladder to selectively float said shroud from a submerged position beneath said boat to a deployed position enveloping the hull of said boat;

a water drain nozzle mounted on said flexible shroud for evacuating sea water from the region between said flexible shroud and said boat hull;

a water pump connected to said water nozzle for controllably pumping out said sea water from said region;

a guide member mounted to the sea bed floor and connected to said bladder, for guiding said shroud from said submerged position beneath said boat into said deployed position enveloping the hull of said boat;

said guide member further comprising:

a pair of anchors mounted to the sea bed floor on opposite sides of said boat;

a pair of pulleys, respectively mounted to each of said anchors;

a pair of buoys respectively connected to one of a pair of guy wires which respectively pass through one of said pair of pulleys, each said guy wire being connected to said bladder;

said bladder having its motion constrained by said guy wires, pulleys, anchors and buoys to remain in substantially the vertical direction in transferring said shroud between said floating and said submerged positions.

* * * * *